United States Patent [19]

Chiaves

[11] 3,977,199

[45] Aug. 31, 1976

[54] SHORING STRUCTURE FOR EMBANKMENTS

[76] Inventor: Carlo Chiaves, Piazza Adriano 6, Turin, Italy

[22] Filed: June 26, 1975

[21] Appl. No.: 590,733

[30] Foreign Application Priority Data

July 1, 1974 Italy ..... 69078/74

[52] U.S. Cl. ..... 61/39; 52/149; 52/169 R

[51] Int. Cl.[2] ..... E02D 5/20

[58] Field of Search ..... 61/39, 49, 35; 52/149, 52/169

[56] References Cited

UNITED STATES PATENTS 3,426,541 2/1969 Chiaves ..... 61/39

FOREIGN PATENTS OR APPLICATIONS 1,402 4/1908 United Kingdom ..... 61/39

*Primary Examiner*—Jacob Shapiro

*Attorney, Agent, or Firm*—Sughrue, Rothwell, Mion, Zinn & Macpeak

[57] ABSTRACT

An embankment support wall is made up of precast concrete panels having rear braces which are embedded with the lower ends of the panels in a subsequently cast concrete bed; to permit the use of a brace of reduced section the latter is curved, with its concave side facing towards the material to be supported.

4 Claims, 4 Drawing Figures

FIG. 4
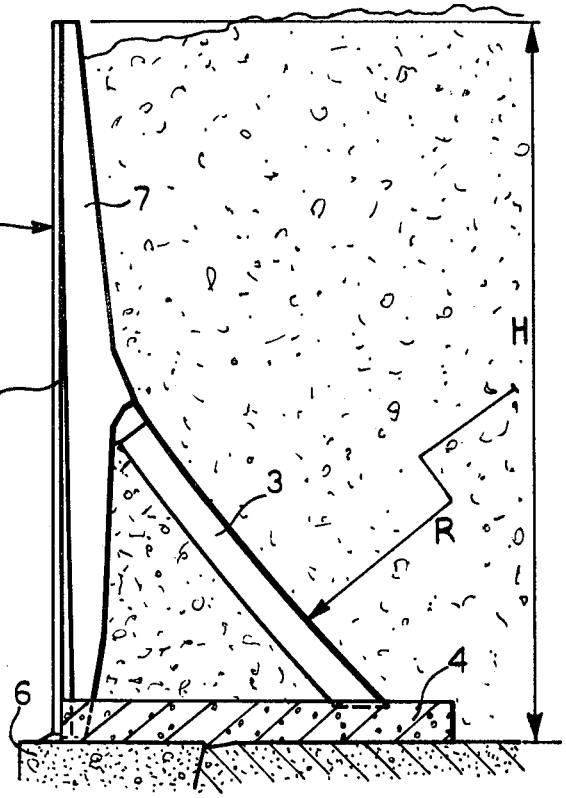
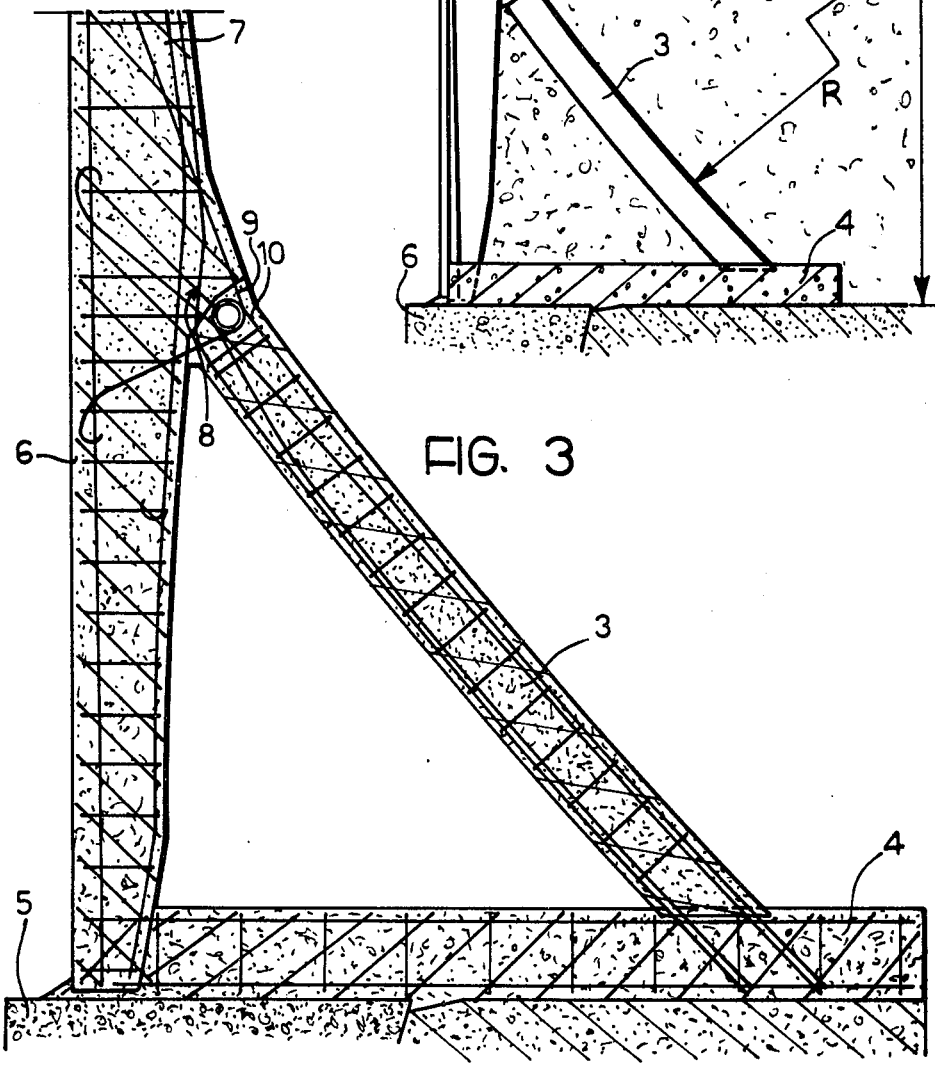
FIG. 3

SHORING STRUCTURE FOR EMBANKMENTS

The present invention refers to embankment shoring structures.

More particularly the invention is concerned with embankment shoring structures of the type consisting of a number of prefabricated reinforced concrete panels disposed substantially vertically side by side on a cast foundation so as to form a supporting wall and subsequently anchored by the casting of a reinforced concrete anchoring bed extending upwards from the bottom of the wall so as to form a unitary structure having a substantially L-shaped transverse section, each panel being connected to a rigid brace one end of which when installed on site is fixed to the wall of the panel facing the material to be supported and the opposite end of which is embedded in the anchoring bed. Such a supporting structure is hereinafter referred to as "the type described".

In my Italian Pat. No. 763879, there is illustrated and described a structure of the aforementioned type in which the brace comprises a straight reinforced concrete arm prefabricated together with the panel and fixed to it, at the end adjoining the bed, by means of a number of steel reinforcements disposed in such a manner as to form in effect a hinge between the brace and the panel itself.

During transportation of the structure, the brace can be kept in a folded position in contact with the facing wall of the panel. When installed on site, the brace is brought into the operative position and on completion of the concrete pouring operation it is rigidly fixed, at one end, to the wall of the panel, and at the opposite end to a point on the anchoring bed. Besides being very cheap, such prefabricated panel units are also very easy to handle, this being of obvious advantage both during transportation and installation. Naturally, the ease of handling such units is strictly related to the dimensions of the brace.

Consequently, the use of such a structure is limited to shoring walls having a height not exceeding 7–8 meters. The dimensions of the brace depend in practice on the weight of the infill material bearing down on them and also on the forces transmitted to the brace itself by the wall of the panel, resulting from the hyperstatic connection between these under operational conditions. Both these factors, which tend to stress the brace, increase rapidly with increase in height of the shoring wall, which must be limited, as already explained.

An object of the present invention is to provide an embankment shoring structure of the type previously described, formed by braced prefabricated panels the braces of which, for a given size of structure, have considerably reduced cross sectional dimensions relative to those employed in present-day construction technique.

With this object in view the present invention provides an embankment shoring structure of the type described in which the brace comprises a curved arm the concave side of which faces towards the material to be supported, away from the supporting wall.

By virtue of the curvature of the brace there is achieved a considerable reduction of the bending moment which, under given conditions, is produced in the various sections of the brace as a result of the pressures exerted by the material to be supported. This allows, therefore, a reduction of the cross-section of the brace, and consequently, of its rigidity. Because the bending moment transmitted by the panel to the brace is proportional to the rigidity of the latter, it follows that the cross-section of the actual brace, for given conditions, is reduced for two reasons.

With this type of construction it is possible to achieve structures which are still cheap and easy to handle, even for structures with a height of the order of 10 – 12 meters.

The radius of curvature of the brace depends not only on the height of the structure but also on the type of material the actual structure is intended to support. The ratio between the radius of curvature of the brace and the height of the supporting structure preferably lies between 1 and 5, according to the conditions and the nature of the supported material. In most cases the radius of curvature of the brace will not be less than 15 meters and not exceed 25 meters.

By using a brace with a constant radius of curvature equal to about 20 meters, satisfactory, if not optimal, results are obtained in all cases where it is feasible to use structures of the type described having a height of between 5 and 10 meters. The adoption of a standard value for the radius of the brace naturally affords considerable advantages from the economic point of view since it allows considerable production savings.

The invention will now be described, by way of non-limiting example, with reference to the appended drawings, in which:

FIGS. 2 and 3 are cross-sectional views of a panel unit forming part of the structure of FIG. 1, before and after installation, respectively, and FIG. 4 is a schematic transverse section of the structure according to the invention, in conditions of use.

Figure 1:
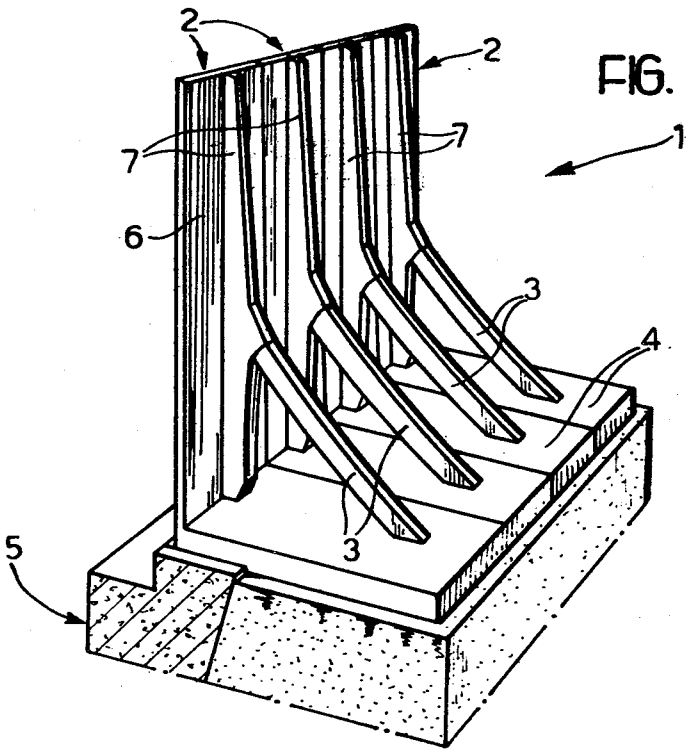
FIG. 1 is a partially sectioned perspective view of an embankment shoring structure according to one embodiment of the invention.

Referring to the drawings a structure 1 for the shoring of embankments, according to the invention, comprises a number of panel units disposed side by side on a cast foundation 5. Each panel unit comprises a panel 2 provided with a brace 3 the lower end of which is embedded in a reinforced concrete anchoring bed 4.

The panels 2 are made of prefabricated reinforced concrete and each has a height H in its vertical installed position. On its surface facing the material to be supported the panel 2 has a longitudinal reinforcing rib 7 which extends from the bed 4 to a point on the rib 7 disposed at approximately half the height of the panel 2. The upper end of the brace 3 is anchored to the rib 7 of the panel 2 by means of internal reinforcing rods 8.

Figure 2:
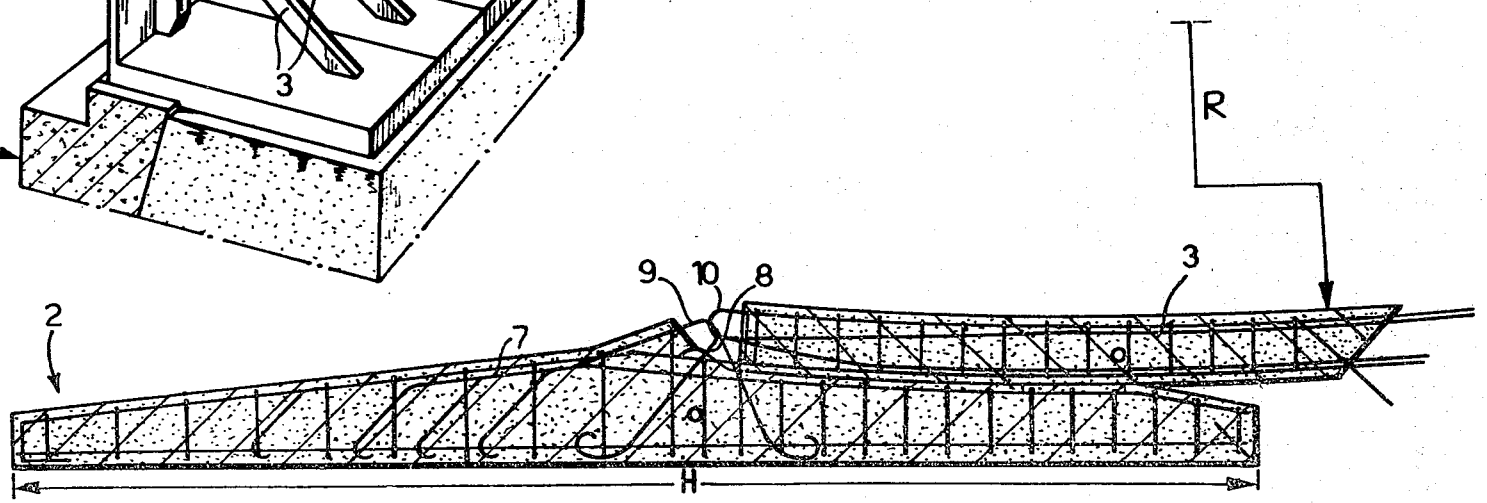

As shown in FIGS. 2 and 3 both the panel 2 and the associated brace 3 are provided with a number of internal reinforcing rods. The reinforcing rods 8 which anchor the brace 3 to the rib 7 are disposed in such a manner as to allow the brace 3 to be hinged relatively to the panel 2 about a horizontal axis.

For transportation purposes the brace 3 is rotated relative to the panel 2 so that it lies flat against the panel 2, as shown in FIG. 2. This presents considerable advantages since it allows a considerable reduction in the overall dimensions of the panel unit for transportation.

When the panel unit is installed on site, the brace 3 is swung outwardly as shown in FIG. 3. The panels 2 are disposed substantially vertically side by side on the cast foundation 5 and subsequently the reinforced concrete anchoring bed 4 is cast on site to enclose the casting 5, the lower ends of the panels 2 and the lower ends of the braces 3 so as to form a unitary structure.

Curved reinforcing rods 10 and 9 project from the upper end of the brace 3 and from the adjoining surface of the associated rib 7 respectively. The position and configuration of the said curved rods 10 and 9 is such that when the brace 3 is in the unfolded, operative, position (FIG. 3), the curved rods partially overlap so as to form a closed eye into which fits a steel tube capable of fixing the brace 3 in its final position.

As shown in the drawings, the brace 3 is curved with its concave side facing towards the material to be supported. R indicates the radius of curvature of the brace 3.

In operational conditions the material supported by the structure exerts a considerable pressure on the brace 3 and tends to bend it towards the panel 2. The curvature of the brace 3, even when slight ($R$= 20 meters), allows a considerable reduction in the bending moments which arise in the various sections of the brace due to the aforementioned pressure exerted by the supported material.

While adhering to the principle of the invention, practical embodiments and manufacturing details can be widely varied, relatively to what has been described and illustrated by way of example, without departing from the scope of the present invention.

It will be seen that the present invention provides, in addition to the embankment shoring structure described, a panel unit for use in forming an embankment shoring structure comprising a reinforced concrete panel and a reinforced concrete brace adapted to be connected at one end to a wall of the panel which in use faces towards the material to be supported, the brace being such that it can lie against the said wall of the panel for transportation and storage, in which the brace is curved with its concave side facing away from the said wall of the panel.

I claim:

1. An embankment shoring structure comprising a cast foundation, a number of prefabricated reinforced concrete panels disposed substantially vertically side by side on the foundation so as to form a supporting wall, a cast reinforced concrete anchoring bed extending upwards from the bottom of the supporting wall so as to form a unitary structure having a substantially L-shaped transverse section, and a rigid brace connected to each panel, each brace when installed on site being fixed at one end to the wall of the panel facing the material to be supported and the opposite end of the brace being embedded in the anchoring bed, wherein the brace comprises a curved arm the concave side of which faces towards the material to be supported, away from the supporting wall.

2. Shoring structure as defined in claim 1, wherein the ratio between the radius of curvature (R) of the brace and the height (H) of the panel to which it is connected is between 1 and 5.

3. Shoring structure as defined in claim 1, wherein the radius of curvature (R) of the curved brace is between 15 and 25 meters.

4. Shoring structure as defined in claim 1, wherein the curved brace has a radius of curvature of substantially 20 meters.

* * * * *